US009435067B2

(12) United States Patent
Kim

(10) Patent No.: US 9,435,067 B2
(45) Date of Patent: Sep. 6, 2016

(54) WALL-MOUNTED WASHING MACHINE

(71) Applicant: Dongbu Daewoo Electronics Corporation, Seoul (KR)

(72) Inventor: Man Ki Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 132 days.

(21) Appl. No.: 14/167,380

(22) Filed: Jan. 29, 2014

(65) Prior Publication Data

US 2015/0184328 A1 Jul. 2, 2015

(30) Foreign Application Priority Data

Dec. 26, 2013 (KR) ..... 10-2013-0164182

(51) Int. Cl.
*D06F 39/12* (2006.01)

(52) U.S. Cl.
CPC ..... *D06F 39/125* (2013.01); *D06F 39/12* (2013.01)

(58) Field of Classification Search
CPC ..... D06F 39/12; D06F 39/125
See application file for complete search history.

(56) References Cited

U.S. PATENT DOCUMENTS

| | | | | |
|---|---|---|---|---|
| 6,256,823 | B1 * | 7/2001 | Kronbetter et al. | 8/158 |
| 2003/0115915 | A1 * | 6/2003 | Nitschmann et al. | 68/139 |
| 2011/0232335 | A1 * | 9/2011 | Johnson et al. | 68/19 |
| 2012/0023721 | A1 * | 2/2012 | Glachet | 29/281.5 |
| 2012/0233873 | A1 * | 9/2012 | Del Pos et al. | 34/108 |
| 2012/0242205 | A1 * | 9/2012 | Del Pos et al. | 312/228 |
| 2013/0019708 | A1 * | 1/2013 | Huang | 74/490.12 |
| 2013/0057130 | A1 * | 3/2013 | Kim et al. | 312/228 |
| 2014/0292166 | A1 | 10/2014 | Hwang et al. | |

FOREIGN PATENT DOCUMENTS

| | | |
|---|---|---|
| JP | H07-12305 | 1/1995 |
| KR | 10-2013-0112672 | 10/2003 |
| KR | 10-2013-0077994 | 7/2013 |

OTHER PUBLICATIONS

Korean Patent Abstracts, Publication No. 10-2013-0112672, Published Oct. 14, 2003, KIPO, Republic of Korea.

* cited by examiner

*Primary Examiner* — Joseph L Perrin

(57) ABSTRACT

A wall-mounted washing machine includes a main body configured to be detachably mounted on a wall, a recess along a peripheral rear surface of the main body and configured to face the wall, and a removable seal in the recess and having a free end configured to contact the wall and block water from outside the washing machine from entering the main body.

11 Claims, 9 Drawing Sheets

도 4

B - B

WALL-MOUNTED WASHING MACHINE

CROSS-REFERENCE TO RELATED APPLICATIONS

This application is based on and claims priority from Korean Patent Application No. 10-2013-0164182, filed on Dec. 26, 2013, the disclosure of which is incorporated herein in its entirety by reference.

TECHNICAL FIELD

The present disclosure relates to a washing machine adapted to be mounted on a wall, and more particularly, to a wall-mounted washing machine capable of preventing water from outside the washing machine from entering inside the washing machine by sealing a clearance or space that may be between the main body of the washing machine and the wall on which the main body is mounted.

BACKGROUND

In general, a drum washing machine is designed to put laundry into the washing machine through a door at a front side of the washing machine.

The drum washing machine includes a cabinet forming an exterior of the washing machine, a tub in the cabinet configured to contain washing water, a rotatable drum in the tub to accommodate laundry, a driving device adjacent to or under the tub for rotating the drum, a means for supplying water to the tub, and a drainage device for discharging the washing water from the tub to the outside of the cabinet after the washing operation is terminated.

When the laundry is put into the drum, water is fed to the tub and the inside of the drum by the water supplying means, and the driving device is activated to rotate the drum, thereby performing the washing operation.

After the washing operation is completed, the washing water in the tub and the drum may be drained to the outside of the cabinet by the operation of the drainage device.

In some embodiments, the drum type washing machine has been recently developed to be mounted on a wall. Since such a wall-mounted washing machine has a small size and/or configuration, it is convenient to install it in a bathroom or restroom.

However, when the wall-mounted washing machine is installed in the bathroom or restroom, it has a disadvantage in that water and/or moisture may enter the washing machine from the outside environment through a gap between the main body of the washing machine and the wall.

Particularly, when the wall is uneven, or if the top of the washing machine separates from the wall for any reason, the depth of the gap or space between the main body and the wall may be unacceptably large. In such case, water may enter the inside of the washing machine.

The water penetrating into the washing machine can cause a belt driven by the driving device (e.g., motor) to slip, thereby reducing the rotational force or rate of the drum. Further, in a severe situation, a current leakage can occur in the washing machine, and parts of the washing machine may be corroded.

Korean Patent Application Publication No. 10-2013-112672 may disclose a conventional wall-mounted washing machine.

SUMMARY

Embodiments of the present disclosure provide a wall-mounted washing machine which is able to block water outside the washing machine from entering inside of the washing machine by sealing a clearance or space between a main body of the washing machine and the wall.

Exemplary embodiments of the present disclosure provide a wall-mounted washing machine including a main body configured to be mounted on a wall; a recess along a peripheral rear surface of the main body, configured to face the wall; and a removable seal in the recess and having a free end configured to contact the wall and block water outside the main body from entering the main body.

The seal may comprise a deformable material.

The seal may be compressed when the main body is mounted on the wall.

The recess may include at least one groove along an inner surface thereof.

The seal may include a projection complementary to the groove and configured to engage with the groove, thereby providing a firm coupling of the seal to the recess.

The exposed or free end of the seal may be exposed prior to mounting the main body on the wall, and the seal may be compressed when the main body is mounted on the wall.

The seal may include an embossing portion at the free or exposed end of the seal to block entry of water into the main body.

The free or exposed end of the seal may include a flange having a cross-section that increases gradually in a direction of the free or exposed end of the seal.

The flange may further include a concave depression, groove or ring along an outer surface thereof.

According to embodiments of the present disclosure, a certain clearance or space between the main body of the washing machine and the wall can be tightly sealed by the seal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
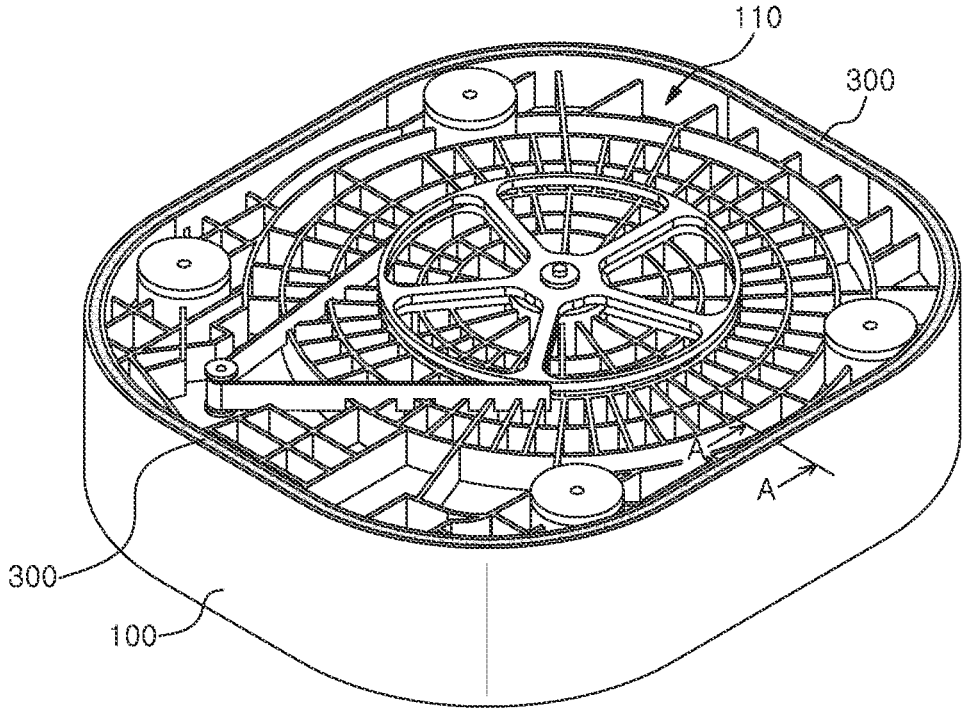
FIG. 1 is a perspective view illustrating a rear surface of a main body of an exemplary wall-mounted washing machine with a seal coupled thereto according to one or more embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced, and a predetermined size or dimension is just exemplary and not limiting. The same reference numerals designate the same structures, elements, or parts illustrated in two or more drawings to exhibit the same or similar characteristics.

Exemplary embodiments of the present disclosure illustrate ideal embodiments of the present disclosure in some detail. As a result, various modifications of the drawings are expected. Accordingly, the disclosed exemplary embodiments are not limited to a specific form or illustration, and for example, include modifications of form by manufacturing.

Hereinafter, exemplary embodiments will be described in detail with reference to the accompanying drawings.

Figure 2:
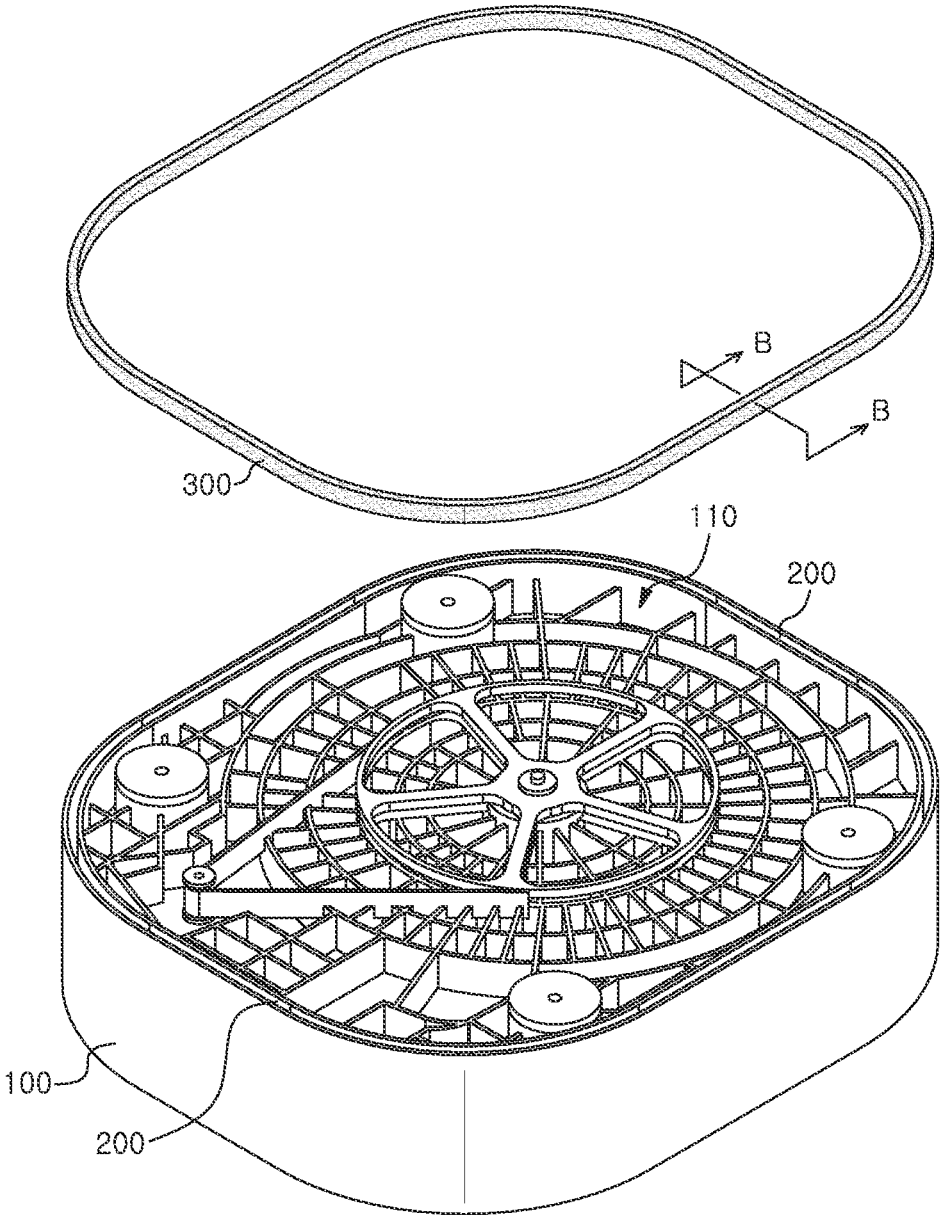
FIG. 2 is a disassembled perspective view illustrating the rear surface of the main body and the seal according to the exemplary embodiment(s) illustrated in FIG. 1.
Figure 3:
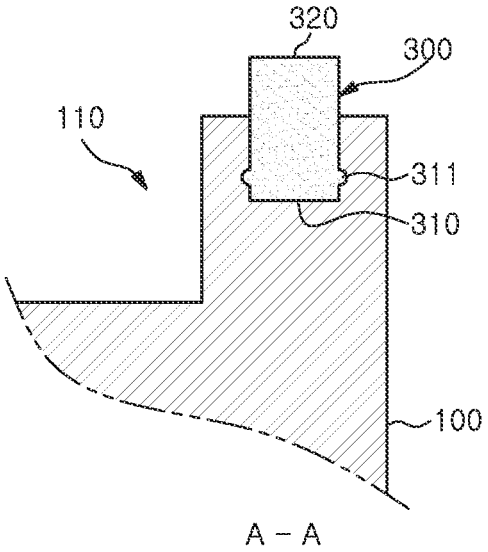
FIG. 3 is a cross-sectional view taken along line A-A of FIG. 1.
Figure 4:
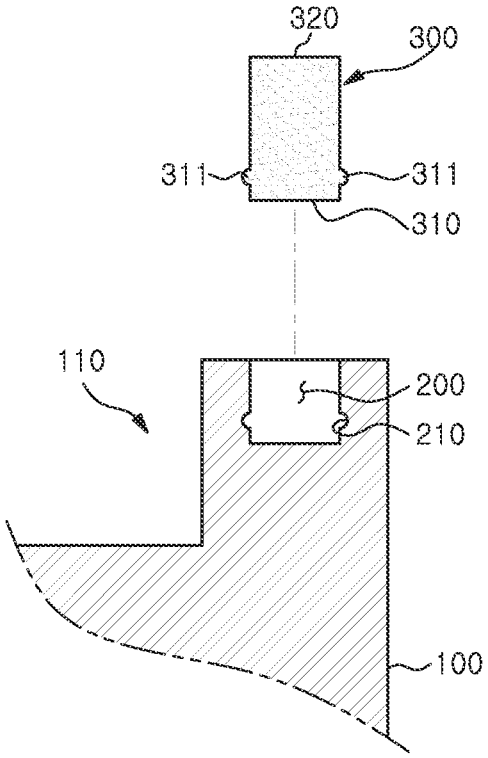
FIG. 4 is a cross-sectional view taken along line B-B of FIG. 2.

FIG. 1 is a perspective view illustrating a rear surface of a main body of an exemplary wall-mounted washing machine with a seal coupled thereto according to exemplary embodiment(s) of the present disclosure. FIG. 2 is a disassembled perspective view illustrating the rear surface of the main body and the seal according to exemplary embodiment(s) illustrated in FIG. 1. FIG. 3 is a cross-sectional view taken along line A-A of FIG. 1, and FIG. 4 is a cross-sectional view taken along line B-B of FIG. 2.

Referring to FIGS. 1 to 4, a wall-mounted washing machine may include a main body 100, a recess 200, and a seal 300.

The main body 100 of the wall-mounted washing machine includes a housing that covers a tub and drum in which laundry is actually washed. The main body 100 of the wall-mounted washing machine may be mounted on a wall 10 by a coupling means such as bolts or screws.

The recess 200 is formed along a periphery of the rear surface 110 of the main body 100 that faces the wall 10. The recess 200 may have a shape that conforms to a periphery or peripheral feature of the main body 100. For example, when the main body 100 has a circular peripheral shape, the recess 200 may be circular, and when the periphery of the main body 100 has a more rectangular configuration (e.g., square or rectangular, optionally with rounded corners), the recess 200 may have a more rectangular shape matching that of the periphery of the main body 100.

Also, as illustrated in FIG. 4, the recess 200 may be in the main body to a depth and/or width sufficient to accommodate the seal. Further, the recess 200 may have an opening at the rear surface 110 of the main body.

The recess 200 may have at least one groove 210 along an inner surface (e.g., one or both sidewalls) thereof. The groove 210 may be continuous along a circumference of the recess 200, and may extend from an inner surface (e.g., sidewall surface) of the recess 200 in a direction perpendicular to the direction in which the recess 200 is formed (e.g., from the rear surface of the main body 100 toward the bottom of the recess, or parallel to the rear surface of the main body 100 and/or the wall). Furthermore, the recess 200 may have an aspect ratio (e.g., a ratio of the depth to the width) of from 1:2 to 2:1 or more. However, the aspect ratio of the recess 200 is generally less than that of the seal 300 (e.g., by 10-25% or more).

Meanwhile, the seal 300 is designed to block entry of water from outside the main body 100 into the main body 100 through a clearance, gap or space between the rear surface 110 of the main body 100 and the wall 10, when the washing machine is mounted on the wall 10. The seal 300 may comprise or consist essentially of an elastically deformable and compressible material (e.g., foam rubber with a water-resistant or waterproof coating thereon). By sealing the clearance with the seal 300 in or engaged with the recess of the main body, the wall-mounted washing machine of various embodiments may have a sealing function for preventing the penetration or entry of water into the washing machine.

One end 310 of the seal 300 may contact the bottom of the recess 200. Further, at least one projection 311 may be formed along a circumference of the seal 300 to engage or mate with the groove 210 of the recess 200. The projection 311 may be complementary to the groove 210 on or in the inner and/or side surface of the recess 200, may be elastically deformed, and may fit into the groove 210.

The engagement of the projection 311 with the groove 210 of the recess 200 enables the seal 300 to be securely fixed or rigidly coupled to the recess 200. Meanwhile, when a replacement of the seal 300 with a new one is required, the user can pull the seal 300 out of the recess 200 causing the projection 311 to elastically deform and decouple from the groove 210, so that the seal 300 may be relatively easily removed or separated from the recess 200.

The other (e.g., the free and/or exposed) end 320, which is opposite to the one (e.g., inserted) end 310, of the seal 300 may contact the wall 10 to block entry of water outside the main body 100 from entering inside the main body 100.

Figure 5:
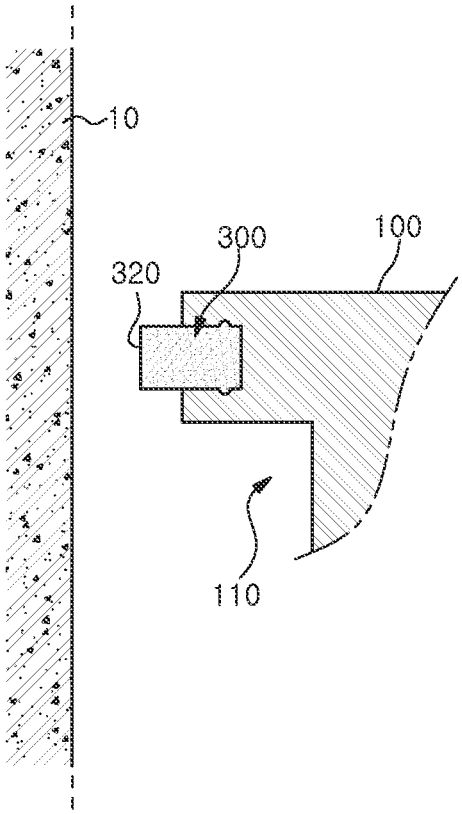
FIGS. 5 and 6 are cross-sectional views illustrating an effect of mounting the exemplary wall-mounted washing machine on the wall according to exemplary embodiment(s) of the present disclosure.
Figure 6:
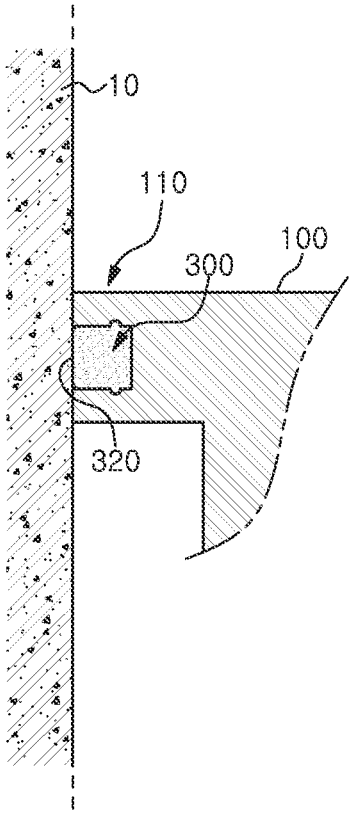

FIGS. 5 and 6 are cross-sectional views illustrating the wall-mounted washing machine mounted on the wall 10 according to exemplary embodiment(s) of the present disclosure. Referring to FIGS. 5 and 6, when the main body 100 is mounted on the wall 10, the seal 300 may be compressed against the wall 10 to tightly contact the wall 10, and the main body 100 may also contact the wall 10 tightly in at least some locations. In a free state of the seal 300, i.e., prior to mounting the washing machine on the wall, the other (exposed) end 320 of the seal 300 may extend from the recess 200 by a certain (e.g., predetermined) height or distance. The other (exposed) end 320 of the seal 300 may be referred as a free end 320. When the main body 100 is mounted on or to the wall 10, the seal 300 may be compressed to tightly seal any clearance or gap between the main body 100 and the wall 10.

As illustrated in FIG. 5, prior to mounting the main body 100 to the wall 10, the free end 320 of the seal 300 extends or protrudes outward from the recess 200. Further, as illustrated in FIG. 6, when the rear surface 110 of the main body 100 is mounted on the wall, the seal 300 may closely contact the wall 10 while being compressed. As a result, any gap between the rear surface 110 of the main body 100 and the wall 10 may be substantially sealed, and therefore, the penetration of water from the outside environment into the inside of the main body 100 may be effectively blocked.

When the main body 100 is fixed to the wall 10 by a coupling means, for example, screws or bolts, the rear surface 110 may be pressed against toward the wall 10 by the screws until it substantially contacts the wall 10. In this regard, the free end 320 of the seal 300 and the rear surface 110 of the main body 100 are coplanar and may form a substantially continuous planar surface, and thus the main body 100 may closely contact the wall 10.

Particularly, when the wall 10 is not even, the clearance (or a gap) between the main body 100 and the wall 10 may be exist or increase. Even in this circumstance, since the seal 300 is compressed to closely contact the wall 10, water cannot enter the inside of the main body 100 due to the tight seal between the main body 100 and the wall 10 by the seal 300.

One or more additional exemplary embodiments of the seal 300 will be described with reference to FIGS. 7 to 9.

Figure 7:
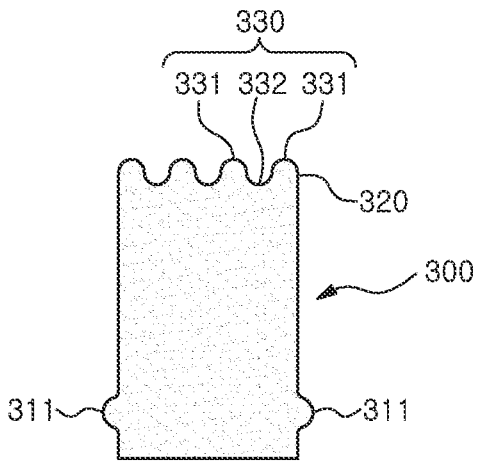
FIG. 7 is a cross-sectional view illustrating a seal according to one or more additional exemplary embodiments of the present disclosure.
Figure 8:
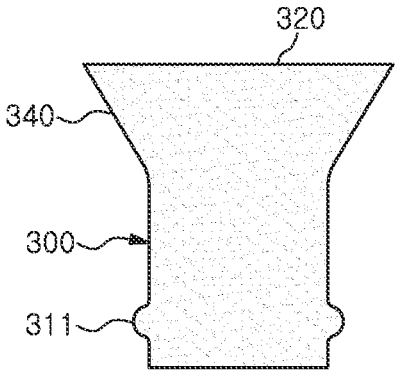
FIGS. 8 and 9 are cross-sectional views illustrating a seal according to still further embodiments of the present disclosure.
Figure 9:
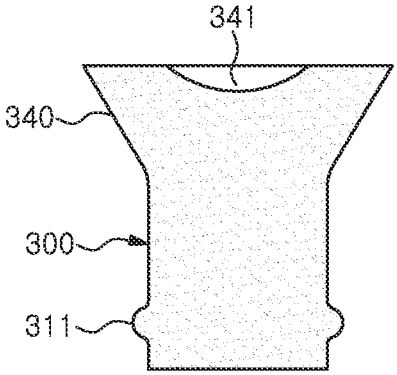

FIG. 7 is a cross-sectional view illustrating a seal according to another exemplary embodiment of the present disclosure; and FIGS. 8 and 9 are cross-sectional views illustrating a seal according to still further embodiments of the present disclosure.

As illustrated in FIG. 7, an embossing portion 330 for blocking entry of water into the main body 100 may be formed at the free end 320 of the seal 300.

The embossing portion 330 may have a structure in which a series of protrusions 331 and recessions 332 are alternately and continuously formed along part or all of the free end 320 of the seal 300. With the embossing portion 330 on the free end 320 of the seal 300, when the rear surface 110 of the main body 100 contacts with the wall 10 and becomes compressed, the contact area of the free end 320 with the wall 10 may increase, and the entire surface area of the embossing portion 330 may substantially decrease. Thus, a further compressive force is concentrated on the protrusions 331 of the embossing portion 330 to more strongly form a seal against the wall 10, and on some embodiments with multiple protrusions 331, form multiple seals against the wall 10. As a result, the sealing of the clearance between the main body 100 and the wall 10 may be further enhanced.

Thus, even in the case where some of water passes through one of the protrusions 331, such water can be blocked by another protrusions 331 next to the one protrusion 331, and the water stays in the recessions 332 therebetween.

As illustrated in FIG. 8, at the free end 320 of the seal 300 is a flange 340 having a structure in which a cross-section of the flange 340 increases gradually in the direction of the exposed end of the seal 300.

With the flange 340 at the free end 320 or the seal 300, the contact area of the free end 320 with the wall 10 may increase. Accordingly, the flange 340 may effectively block water from penetrating through the clearance between the seal 300 and the wall 10, and in some cases, may guide water away from the wall along a channel that may form at the interface between the seal 300 and the rear surface of the mail body 100.

Also, as illustrated in FIG. 9, the flange 340 may have a concave depression or groove 341 formed along the exposed surface (e.g., the top) of the flange 340. The concave depression or groove 341 may have an opening at a rear (e.g., exposed) surface of the flange 340 and be configured such that the flange 340 may be compressed against the wall 10. For example, the concave depression or groove 341 may form a continuous and/or concentric ring on the exposed surface of the free end of the seal 300.

When the rear surface 110 of the main body 100 closely contacts the wall 10, air contained in the concave depression or groove 341 may be discharged to the outside of the seal 300, creating a vacuum therein. As a result, the seal 300 can contact and/or be secured to the wall even more strongly.

As described above, the seal 300 in the wall-mounted washing machine having a water seal function according to embodiments of the present disclosure is capable of sealing a clearance or gap between the main body 100 and the wall, even when the washing machine is installed in a bathroom or restroom in which water is frequently used and which may form or otherwise get on the wall. Therefore, penetration of water from the outside environment into the main body 100 of the washing machine may be effectively blocked.

Further, the slippage of a driving belt in the main body 100, current leakage, and/or corrosion of interior parts of the washing machine may be effectively prevented.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A wall-mounted washing machine comprising:

a main body configured to be mounted on a wall;

a recess provided along a peripheral rear surface of the main body, configured to face the wall, and having an opening at the peripheral rear surface; and a removable seal in the recess and having a free end configured to contact the wall facing the peripheral rear surface of the main body and block water from entering the main body;

wherein the free end of the seal includes an embossing portion having a series of protrusions and recessions that are alternately and continuously formed along the free end to block entry of water into the main body, wherein the protrusions of the embossing portion protrudes toward the wall facing the peripheral rear surface of the main body, and wherein the embossing portion is configured to be compressed by the wall facing the peripheral rear surface of the main body.

2. The washing machine of claim 1, wherein said seal comprises a deformable material.

3. The washing machine of claim 2, wherein said seal is compressible.

4. The washing machine of claim 1, wherein said recess has at least one groove along an inner surface thereof.

5. The washing machine of claim 4, wherein said seal comprises a projection complementary to the groove.

6. The washing machine of claim 5, wherein said projection is configured to engage with the groove.

7. The washing machine of claim 1, wherein said free end of the seal is exposed prior to mounting the main body to the wall, and compressed when the main body is mounted on the wall.

8. The washing machine of claim 1, wherein the rear surface of the main body is vertical when the washing machine is mounted on the wall.

9. The washing machine of claim 8, further comprising a plurality of fastening members configured to fasten or fix the main body to the wall.

10. The washing machine of claim 9, wherein each of said plurality of fastening members comprises a bolt or a screw, and the main body comprises a plurality of openings through which a corresponding fastening member passes.

11. The washing machine of claim 1, further comprising a motor configured to provide a rotational force, and a belt configured to transfer the rotational force to a drum of the washing machine, wherein the motor and the belt are inside the peripheral rear surface of the main body.

* * * * *